United States Patent [19]

Aryamane

[11] 4,023,265

[45] May 17, 1977

[54] METHOD OF MAKING A MINIATURE PLUG-IN FUSE

[75] Inventor: Avinash P. Aryamane, Mount Prospect, Ill.

[73] Assignee: Littelfuse, Inc., Des Plaines, Ill.

[22] Filed: June 2, 1976

[21] Appl. No.: 692,040

Related U.S. Application Data

[63] Continuation of Ser. No. 640,253, Dec. 12, 1975, abandoned.

[52] U.S. Cl. ..... 29/623; 29/417; 113/116 P; 113/119; 337/198; 337/264; 337/295

[51] Int. Cl.² ..... H01H 69/02

[58] Field of Search ..... 29/610 R, 623, DIG. 15, 29/414, 417; 113/119, 116 P, 116 Y; 339/62, 147 P, 208; 337/198, 187, 201, 206, 255, 262, 263, 264, 293, 295, 297

[56] References Cited

UNITED STATES PATENTS

| | | | |
|---|---|---|---|
| 1,777,916 | 10/1930 | Glössl | 29/623 X |
| 1,926,445 | 9/1933 | Klopfenstein | 337/264 |
| 2,908,887 | 10/1959 | Broske | 113/119 |
| 3,436,711 | 4/1969 | Borzoni | 337/198 |
| 3,669,054 | 6/1972 | Desso et al. | 113/119 |
| 3,775,723 | 11/1973 | Mamrick et al. | 337/297 X |
| 3,775,724 | 11/1973 | Mamrick et al. | 337/297 X |

FOREIGN PATENTS OR APPLICATIONS

| | | | |
|---|---|---|---|
| 1,237,325 | 6/1960 | France | 29/623 |
| 456,749 | 7/1968 | Switzerland | 29/623 |

*Primary Examiner*—Victor A. Dipalma
*Attorney, Agent, or Firm*—Wallenstein, Spangenberg, Hattis & Strampel

[57] ABSTRACT

A method is disclosed for making a plug-in fuse assembly like that disclosed and claimed in U.S. Pat. No. 3,909,767, granted Sept. 30, 1975 for Miniature Plug-In Fuse. The method comprises the steps of providing a blank of fuse metal which is initially provided throughout its length with a continuous central portion of reduced thickness, blanking the blank of fuse metal to form a pair of laterally spaced coplanar terminal forming blade portions which are interconnected by a transverse web of reduced thickness, coplanar current carrying extensions thereof and an interconnecting fuse-forming link portion of reduced thickness located in a coplanar plate-like body of a plug-in fuse element, inserting over said blank a synthetic plastic housing by way of an opening at the inwardly facing side thereof with the current carrying extensions of the blank and the interconnecting fuse-forming link portion of reduced thickness within the housing and with the pair of terminal blade portions of the blank, which are interconnected by the transverse web of reduced thickness, extending outwardly from the housing element through the opening therein, securing said blank in the synthetic plastic housing, and blanking the exposed transverse web of reduced thickness interconnecting the terminal blade portions to complete the formation of the coplanar plate-like body having a pair of laterally spaced coplanar terminal portions of the plug-in fuse assembly.

18 Claims, 12 Drawing Figures

FIG. 5
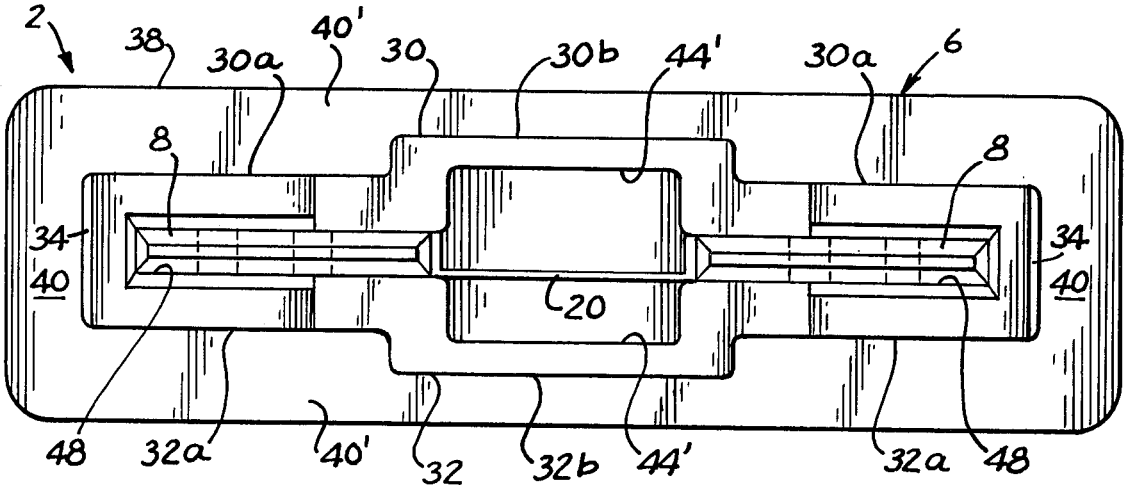
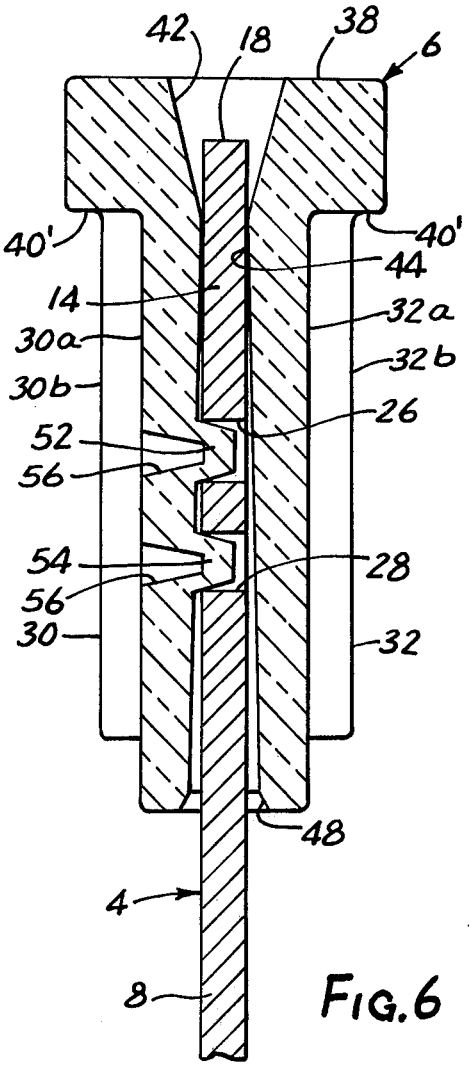
FIG. 6
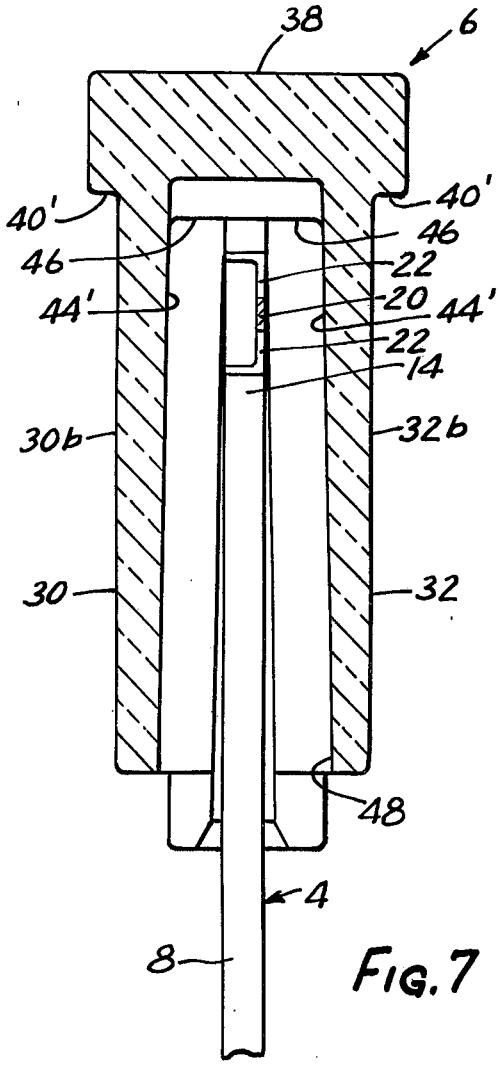
FIG. 7

METHOD OF MAKING A MINIATURE PLUG-IN FUSE

RELATED APPLICATIONS

This application is an improvement over co-pending application Ser. No. 610,978 now U.S. Pat. No. 3,962,782, filed Sept. 8, 1975 for Method of Making a Miniature Plug-In Fuse and a continuation of application Ser. No. 640,253, filed Dec. 12, 1975, now abandoned.

The principal object of this invention is to provide an improved method for making a plug-in fuse assembly like the miniature plug-in fuse disclosed in U. S. Pat. No. 3,909,767, granted Sept. 30, 1975, and which constitutes an improvement over the method of making a miniature plug-in fuse disclosed in co-pending application Ser. No. 610,978, filed Sept. 8, 1975. More particularly, an object of this invention is to provide an improved method which eliminates the problems involved in the practice of the method of said co-pending application Ser. No. 610,978.

SUMMARY OF THE INVENTION

Briefly, this invention has to do with a method of making a plug-in fuse assembly like that disclosed in U.S. Pat. No. 3,909,767, granted Sept. 30, 1975, and which preferably comprises a plug-in element including a coplanar plate-like body of fuse metal having a pair of spaced confronting coplanar terminal forming blade portions to be received by pressure clip terminals in a mounting panel, coplanar current carrying extensions at the inner end portions of the pair of terminal forming blade portions and a fuse-forming link portion of reduced thickness interconnecting the current carrying extensions, and a synthetic plastic housing, which can be comprised of two confronting housing halves which can be assembled or snapped over the plug-in element, but which is preferably a one piece housing which is open at the inwardly facing side thereof, and which contains the coplanar plate-like body of the plug-in element with the current carrying extensions and the interconnecting fuse-forming link portion thereof of reduced thickness within the housing and with the pair of terminals forming blade portions thereof extending outwardly from the housing and preferably through the opening therein.

In accordance with this invention, the method of making such a plug-in fuse assembly comprises providing a blank of fuse metal which is blanked or stamped to form the pair of laterally spaced coplanar terminal forming blade portions which are interconnected by a transvese web, the coplanar current carrying extensions thereof and the interconnecting fuse-forming link portion of reduced thickness involved in the coplanar platelike body of the plug-in element.

The synthetic plastic housing is inserted over said blank of fuse metal, preferably by way of the opening at the inwardly facing side of the one piece synthetic plastic member, with the current carrying extensions and the interconnecting fuse-forming link portion of reduced thickness of the blank within the housing and with the pair of terminal blade portions of the blank, which are interconnected by the transverse web, extending outwardly from the housing element preferably through the opening therein. The blank of fuse metal is suitably secured in the synthetic plastic housing element as by staking or the like.

The exposed transverse web interconnecting the pair of terminal blade portions adds rigidity to the blank and securely maintains the relative positions of the pair of terminal blade portions, the current carrying extensions and the interconnecting fuse-forming link portion of reduced thickness, as the synthetic plastic housing is inserted over and secured to the blank. Thus, distortion, breakage or other damage to the blank is effectively prevented during these operations. The exposed transverse web of fuse metal interconnecting the exposed terminal blade portions of the blank is then blanked or stamped out to complete the formation of the coplanar plate-like body of fuse metal having the pair of laterally spaced coplanar terminal portions and of the plug-in fuse assembly. Also, the outer end portions of the exposed pair of terminal forming blade portions may be coined to form tapers thereon to facilitate insertion thereof into the clip terminals in mounting panel.

In the aforementioned U.S. Pat. No. 3,909,767 and in the method of the aforementioned co-pending application Ser. No. 610,978, the reduced thickness of the interconnecting fuse-forming link portion is provided by initially milling and squeezing the blank of fuse metal only at a point in the blank where the interconnecting fuse-forming link portion is formed by the subsequent blanking operation. This requires a separate milling and squeezing operation at a precise point in each blank of fuse metal. With this procedure it is extremely difficult to maintain sufficiently accurate tolerances for the reduced thickness of the fuse-forming link portion of the plug-in element, and this is compounded where the blanks form integral parts of a continuous intermittently advanced strip of fuse metal, wherein deviations in reduced thickness can also occur from blank to blank, all of which is detrimental to mass production of plug-in fuse assemblies having accurate fuse ratings. In addition to this problem of maintaining tolerances and accurate fuse ratings there is also the problem of time consumption and cost in such procedure.

In the method of the instant invention, the aforesaid milling and squeezing operation at precise points in each blank and the aforementioned problems involved therewith are eliminated. In the method of this invention, the blank of fuse metal is initially longitudinally provided throughout its length with a continuous central portion of reduced thickness so that, when the blank is blanked, the interconnecting fuse-forming link portion of the blank is of less thickness than the spaced coplanar terminal forming blade portions and the current carrying extensions. By controlling the thickness of the fuse-forming link portion of reduced thickness, desired selected ampere ratings for the fuse assembly may be obtained without the need for changing the width or configuration of the interconnecting fuse-forming link portion. Preferably, a continuous strip of fuse metal is utilized which is initially longitudinally provided throughout its length with a continuous central portion of reduced thickness from which the coplanar plate-like bodies of the plug-in elements are to be formed. The continuous central portion of reduced thickness is preferably provided in the continuous strip of fuse metal by controlled conventional continuous milling and scarfing procedures, whereby the tolerances of the continuous central portion of reduced thickness throughout the length of the strip of fuse metal are kept within close limits. As a result, the thicknesses of the fuse-forming link portions of reduced thickness of the coplanar plate-like bodies of the plug-in elements, subsequently blanked from the strip, are maintained within close tolerances, not only in each plug-in element, but, also, from plug-in element to plug-in element blanked from the continuous strip.

The central portion of reduced thickness of the continuous strip or blank of fuse metal may be formed by milling and scarfing both sides thereof or by milling and scarfing only one side thereof. The strip or blank of fuse metal may also be plated, such as tin plated, to provide improved electrical contact of the coplanar terminal forming blade portions of the ultimate plug-in element with the pressure clip terminals in the mounting panel in which they are received.

As the strip of fuse metal having the continuous central portion of reduced thickness is sequentially advanced, it is blanked to provide at spaced intervals in the strip longitudinally interconnected blanks, each containing the pair of laterally spaced coplanar terminal forming blade portions which are interconnected by the transverse web, the coplanar current carrying extensions thereof and the interconnecting fuse-forming link portion of reduced thickness involved in the coplanar plate-like body of the plug-in element.

In this connection, the method includes severing the end blank from the sequentially advancing strip of fuse metal and longitudinally inserting over said end blank of the sequentially advancing strip the synthetic plastic housing with the current carrying extensions and the interconnecting fuseforming link portion of reduced thickness of the end blank within the housing and with the pair of terminal blade portions of the end blank, which are interconnected by the transverse web of the strip, extending outwardly from the housing through the opening therein. Said end blank of the strip is also secured in the synthetic plastic housing. As expressed above, the exposed transverse web interconnecting the pair of terminal blade portions adds rigidity to the blank as the synthetic plastic housing is inserted over and secured to the blank. Since the strip of fuse metal and, hence, the blanks formed therefrom are provided throughout their lengths with a central portion of reduced thickness, the transverse web, interconnecting the pair of terminal blade portions, is also of reduced thickness as is the fuse-forming link portion. However, the exposed transverse web has considerable width compared to the width of the fuse-forming link portion and is wholly effective in preventing distortion, breakage or other damage to the blank as it is inseted in and secured to the housing. When the housing is applied and secured to the current carrying extensions of the fuse element where it supports and holds the fuse element in a manner which eliminates all stresses in the fuseforming link portion.

Further objects of this invention reside in the particular method steps and in the cooperative relationship between the method steps in making the aforementioned plug-in fuse assembly.

Other objects and advantages of this invention will become apparent to those skilled in the art upon reference to the accompanying specification, claims and drawings.

DESCRIPTION OF THE DRAWINGS

FIG. 5 is an enlarged bottom view of the plug-in fuse assembly of FIG. 1;

FIG. 6 is an enlarged transverse vertical sectional view through the plug-in fuse assembly shown in FIG. 4, taken along section line 6—6 thereof;

FIG. 7 is an enlarged vertical transverse sectional view through the center portion of the plug-in fuse assembly shown in FIG. 4, taken along section line 7—7 thereof;

DESCRIPTION OF THE PREFERRED EMBODIMENT OF THE INVENTION

Referring now more particularly to FIGS. 1–4, there is shown a plug-in fuse assembly 2 made of only two component parts, namely a plug-in fuse element 4 which most advantageously is a single stamping from a strip of fuse metal, and a housing 6 which most advantageously is a single piece synthetic plastic molded part defining a space therein into which portions of the plug-in fuse element 4 extend and are secured in any suitable way, but most preferably by a cold staking operation to be described.

Figure 1:
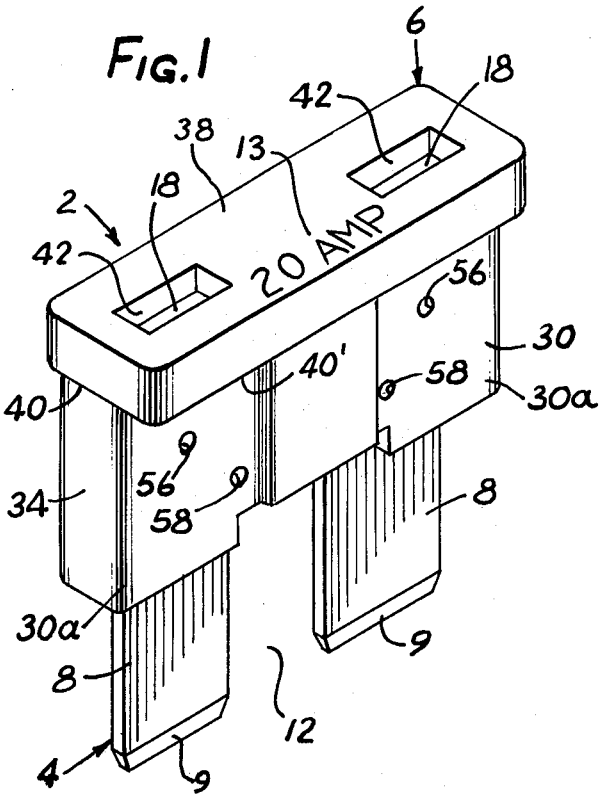
FIG. 1 is a perspective view of a preferred form of the plug-in fuse assembly of the invention.
Figure 2:
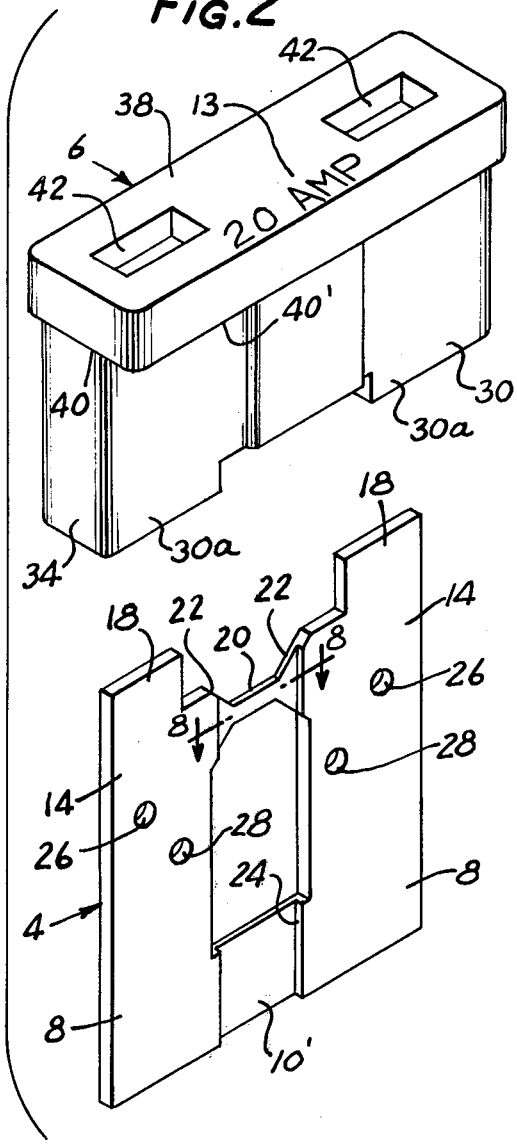
FIG. 2 is an exploded view of the housing and plug-in fuse element for making up the plug-in fuse assembly of FIG. 1.
Figure 3:
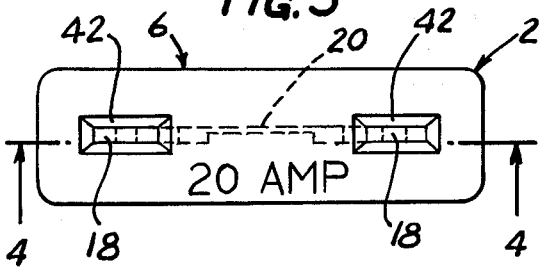
FIG. 3 is a top plan view of the plug-in fuse assembly of FIG. 1.
Figure 4:
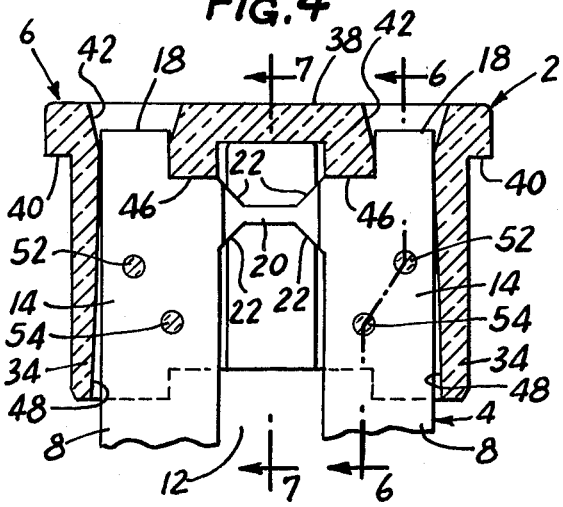
FIG. 4 is a vertical longitudinal sectional view through the plug-in fuse assembly shown in FIG. 3, taken along section line 4—4 therein.

The plug-in fuse element 4 has terminal-forming blade portions 8—8 extending in spaced parallel relationship from the inner or bottom margin of the housing 6 in what will be referred to as a downward or inwardly extending direction. The ends of the terminal-forming blade portions 8—8 of the plug-in fuse element, which are spaced apart as indicated at 12, are most advantageously tapered at 9—9 to form pointed end portions which readily slip into place between the confronting walls of conventional spring clip terminals (not shown) supported in mounting panel apertures. The current rating of the plug-in fuse assembly is indicated by indicia 13 on the outer walls of the housing as shown in FIGS 1–3.

Figure 10:
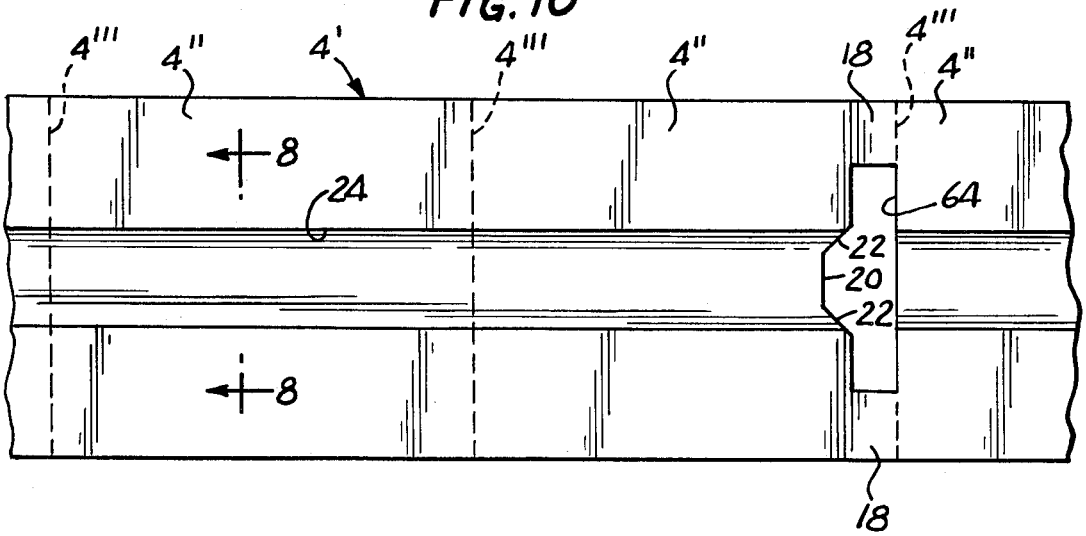
FIG. 10 is a side view of the strip of fuse metal having the elongated central portion of reduced thickness from which the plug-in fuse elements are blanked, and also showing a first blanking step if such step is desired.
Figure 11:
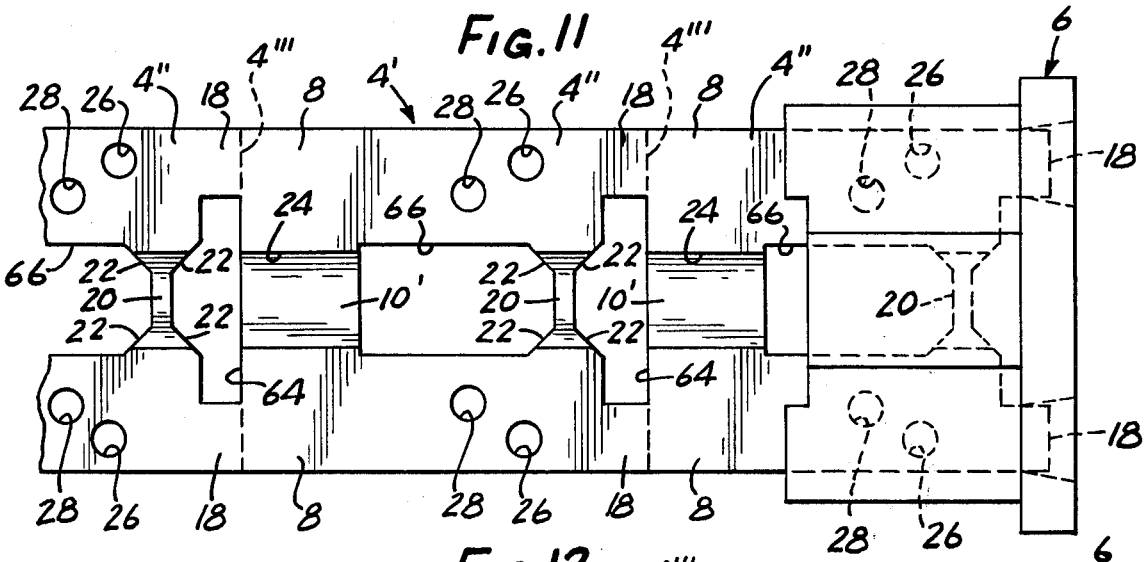
FIG. 11 is a side view of the strip of fuse metal as shown in FIG. 10 but showing the second blanking step to provide the plurality of blanks forming the plug-in fuse elements and the insertion of the housing onto the end blank of the strip.
Figure 12:
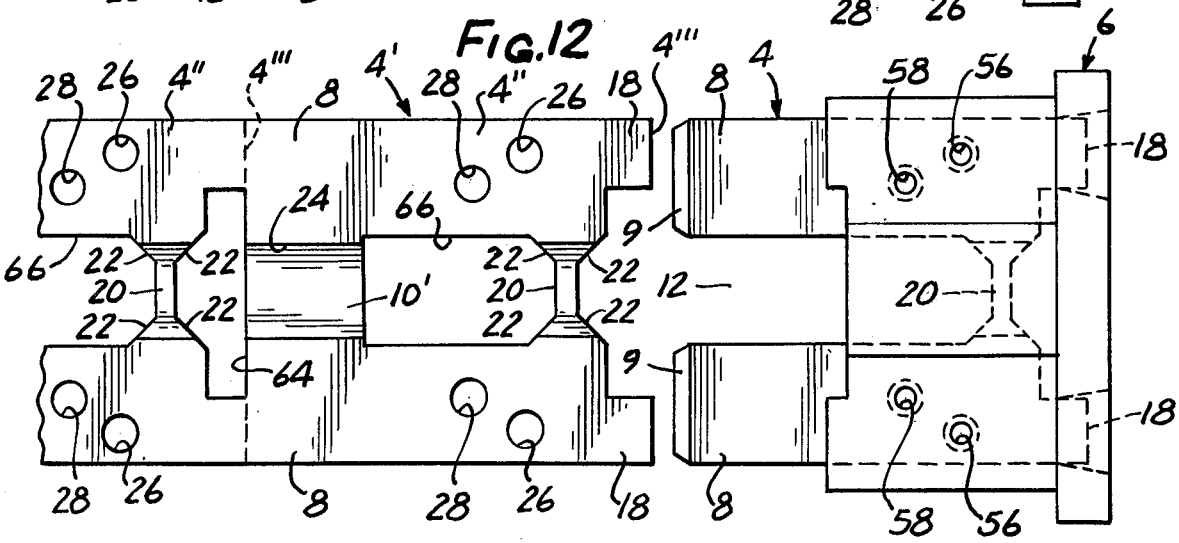
FIG. 12 is a view similar to FIG. 11 showing the separation from the strip of fuse metal the completed plug-in fuse assembly.

The plug-in fuse element 4 is blanked or stamped from a strip 4' of fuse metal (FIGS. 10 to 12). Prior to the plug-in fuse element being severed from the strip 4', the terminal forming blade portions 8—8 are interconnected to form a transverse rigidifying web 10' for the strip 4', and so a central portion of material is stampled from the transverse web 10' to form the terminal-forming blade portions 8—8 and a gap 12 between the same. The tapered portions 9—9 of the terminal-forming blade portions 8—8 may be formed by coining dies (not shown) during the operation which severs the plug-in fuse element from the strip or preferably thereafter.

The terminal-forming blade portions 8—8 have current carrying extensions 14—14 projecting into the aforementioned space formed by the housing 6, which current-carrying extensions project well up into the upper or outer extremities of the housing 6, to be contiguous to the front or outer wall of the housing to be described. The outer end portions of the currentcarrying extensions 14—14 are interconnected by a fuse-forming link portion 20 which is preferably both narrower in width and much smaller in thickness than the other current-carrying portions of the plug-in fuse element 4. The current-carrying capacity of the fuse-forming link portion 20 may be varied by varying the fuse metal composition or by varying the thickness of the fuseforming link portion. In the particular configuration of the plug-in fuse element 4 shown in the drawngs the current carrying extensions 14—14 join the fuse-forming link portion 20 of the plug-in fuse element 4 by tapered portions 22—22. All of the various parts of the plug-in fuse element are substantially in coplanar relation so no metal bending operations need be performed in the process of making the same.

Figure 9:
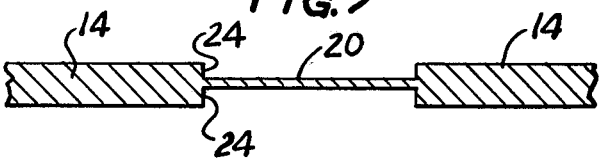
FIG. 9 is a view similar to FIG. 8 showing a different manner in which the fuse-forming link portion is reduced in thickness.
Figure 8:
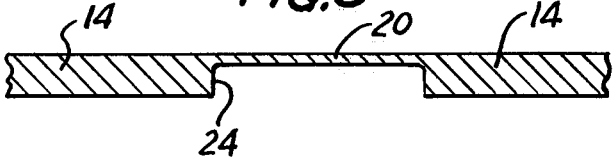
FIG. 8 is a greatly enlarged fragmentary sectional view through the fuse link portion of the plug-in fuse assembly shown in FIG. 2, taken along section line 8—8 of FIGS. 2 and 10, and showing the preferred manner in which the fuse-forming link portion thereof is reduced in thickness.

The reduction of the thickness of the fuse metal of the fuse-forming link portion 20 is preferably achieved by initially providing the strip 4' of fuse metal and, hence, the blanks 4'' of the strip with a centrally arranged groove 24 extending longitudinally throughout the strip 4', as shown in FIGS. 8 and 10, to provide a longitudinally extending central portion of reduced thickness in the strip 4' and the blanks 4''. Alternatively, the strip 4' may be provided with a groove 24 on both sides of the strip, as illustrated in FIG. 9, to provide the longitudinally extending central portion of reduced thickness in the strip 4' and the blanks 4'', the central portion of reduced thickness being located substantially midway of the thickness of the strip in FIG. 9, as distinguished from being located at one face of the strip as in FIG. 8. The groove or grooves 24 are preferably formed in the strip 4' by initially milling and scarfing the strip under close control of tolerances in conventional fashion to provide a central portion of reduced thickness in the strip of fuse metal which is maintained within close tolerances.

The fuse ratings of the plug-in fuse assembly may be accurately determined by the composition of the fuse metal in the strip 4' of fuse metal and the thickness of the fuse-forming link portion 20 of reduced thickness without the need for varying the length of the fuse-forming link portion 20 or the width thereof, so that various fuse ratings may be obtained without any change in the blanking dies for forming the plug-in fuse elements. For example, with a fuse-forming link portion 20 having a length of 0.156 inches related to the width of the groove or grooves 24 in the strip 4' of fuse metal and a width of 0.0350–0.0355 inches, and formed from a zinc alloy fuse metal strip 4' of substantially 0.026 inches ± 0.005 inches in thickness and having the following composition in weight percent, Fe 0.08 max., Cd. 0.07 max., Cu 0.75–1.25, Pb 0.10 max., Mg 0.01 max. and Zn balance, the following fuse ratings in amperes are obtained with the following thicknesses of the reduced thickness fuse forming portion 20:

| Rating in amps | Thickness in '' |
|---|---|
| 5 | 0.0020 – 0.0022 |
| 10 | 0.0044 – 0.0046 |
| 15 | 0.0075 – 0.0079 |
| 20 | 0.0110 – 0.0115 |
| 25 | 0.0150 – 0.0155 |
| 30 | 0.0200 – 0.0205 |

While the plug-in fuse element 4 may be used as a fuse element without its incorporation in the housing 6, for safety reasons it is preferred to incorporate the plug-in fuse element 4 in the housing 6. To this end, and for reasons to be explained, the outer end portions of the terminal extensions 14—14 are provided with outwardly or upwardly projecting tabs 18—18 adapted to make contact with test probes to test for the continuity of the fuse-forming link portion 20 of the plug-in fuse element 4. Also, to anchor the plug-in fuse element 4 within the housing 6, anchoring apertures 26—26 and 28—28 are respectively formed in the terminal extensions 14—14 to receive anchoring projections to be described formed in the housing walls.

While the housing 6 could be made in two separate parts snappable together, the housing is most advantageously a single piece molded part as previously indicated. Also, it preferably has a narrow elongated configuration formed by relatively closely spaced side walls generally indicated by reference numeral 30–32 , the side walls having end portions 30*a*–32*a* and 30*a*–32*a* which are spaced together much more closely than the central or intermediate portions 30*b*–32*b* thereof. The side walls 30–32 are interconnected at their end margins by narrow end walls 34—34, and at their outer or top margins by an outer wall 38 which overhangs the rest of the housing to form downwardly facing shoulders 40—40 at the longitudinal ends of the outer wall 38 and downwardly facing shoulders 40'—40' along the longitudinal side margins of the housing 6. The shoulders 40'—40' are coplanar continuations of the shoulders 40—40 at the ends of the housing 6.

Terminal access openings 42—42 are provided in the outer wall 38 adjacent the opposite end portions thereof in alignment with the location of the test probe-receiving tabs 18—18 of the plug-in fuse element 4. The walls of the terminal access openings 42—42 taper down to an inner dimension which approximates the width of the test probe-receiving tabs 18—18 so that test can be guided into contact with the tabs 18—18. The terminal access openings 42—42 communicate with the aforementioned plug-in fuse element receiving space in the housing 4. The portions 44—44 of this space immediately beneath the access openings 42—42 are relatively small because of the close spacing of the side wall portions 30*a*–32*a* of the housing at these points, the width of the space portions 44—44 as viewed in FIG. 6 tapering from the bottom open end of the housing upwardly toward the terminal access openings 42—42, reaching a narrow dimension about equal to the thickness of the plug-in fuse element 4. At the inner margins of the terminal access openings 42—42 the upper wall 38 is provided with downwardly extending skirts 46—46 which act as shield walls preventing spewing fuse metal from gaining entrance to the terminal access openings 42—42. These shield forming skirts 46—46 also act as stop or abutment shoulders for the current-carrying extensions 14—14 of the terminal-forming blade portions 8—8 of the plug-in fuse element.

The fuse-forming link portion 20 of the fuse element 4 is positioned in a relatively wide portion 44′ (FIG. 7) of the housing interior, to provide for free circulation of air around the center portion of the fuse-forming link portion, which is the part thereof which first melts under excessive current flow, so heat does not accumulate which would adversely affect the current at which the fuse will blow.

The narrow and wide portions 44—44 and 44′ of the space within the housing 6 open onto the bottom of the housing for the full extent thereof through an entry opening 48. The opening 48 permits the housing to be pushed over the end portion or end blank of the pre-stamped and milled strip 4′ from which a completed fuse element is punched immediately following the securing of the housing 6 to the end portion or end blank of the strip as previously indicated.

The housing 6 is preferably a molded part made of a transparent synthetic plastic material so that the fuse-forming filament portion 20 of the plug-in fuse element 4 is readily visible through the intermediate portion of the outer wall 38, to which the fuse-forming link portion 20 is in spaced but relatively contiguous relation. The housing is preferably molded of a high temperature transparent nylon made by Belding Chemical Industries of New York City, New York (Produce Code No. LX-3330)

While the housing interior 6 could be made with resilient projections which snap into the anchoring apertures 26—26 and 28—28 in the plug-in fuse element 4, it is preferred to secure the housing in place by forming projections 52 and 54, by a cold staking operation, ultrasonic melting or other operation, which enter the anchoring apertures 26—26 and 28—28 of the plug-in fuse element 4. The depressions 56 and 58 left by a staking operation are shown in the side wall 30 in FIGS. 1 and 6.

The exemplary embodiments of the invention just described have thus provided an exceedingly reliable, compact and inexpensive to manufacture plug-in fuse assembly which can be readily inserted into and removed from suitable closely spaced spring clip terminal connectors in a mounting panel by grasping the shoulders 40—40 at the longitudinal ends of the housing 6. The transparent material out of which the housing 6 is made forms a convenient window in the outer wall through which the fuse-forming link portion of the plug-in fuse element can be viewed when the plug-in fuse assembly is mounted on the mounting panel. The terminal access openings enable test equipment to test the continuity of the fuse if the user does not desire to rely solely on a visual observation of the fuse-forming link portion of the fuse.

The preferred method of making the plug-in fuse assembly is illustrated in FIGS. 10 to 12. It includes providing a continuous strip 4′ of a fuse metal which is sequentially advanced the distance of a blank 4″ between distances 4‴ as indicated in dotted lines in these figures. The strip 4′ is initially provided throughout its length with a centrally arranged groove or grooves 24 to provide the strip with a longitudinally extending central portion of reduced thickness, as illustrated in the left hand portion of FIG. 10.

The advancing strip 4′ of fuse metal is then blanked to form the terminal portions 8, the current carrying extensions 14 thereof and the further extensions 18 thereof, and the fuse-forming portion 20 of reduced thickness. This may be accomplished in one blanking operation or in a plurality of blanking operations. As illustrated herein, the blanking operation is accomplished in two steps. The first blanking step in the sequentially advancing strip 4′ is illustrated in the right hand portion of FIG. 10 wherein each blank 4″ is sequentially blanked as indicated at 64 to provide the extensions 18 and a portion of the fuse link 20 having the tapered portions 22. Thereafter, each blank is sequentially blanked as illustrated in FIG. 11 at 66 to provide the current carrying extensions 14 and the other portion of the fuse link 20 of reduced thickness extending between the current carrying extensions 14 and having the tapered portions 22. During this same blanking operation the interlocking holes 26 and 28 are also blanked. In this blanking operation the transverse web 10′ still remains between the terminal forming blade portions 8 of each blank. Because of the groove or grooves 24 extending throughout the length of the strip 4′ of fuse metal, the transverse web 10′ is also of reduced thickness, but it has sufficient rigidity and strength to rigidify the plug-in fuse elements 4 during the processing thereof.

As shown in FIG. 11, the housing 6 is inserted over the end blank 4″ to receive the current carrying extensions 14 and further extensions 18 thereof and the fuse-forming link portion 20 within the housing and with the terminal forming blade portions 8 still interconnected by the transverse web 10′ extending from the housing. The housing is then cold staked and/or ultrasonically secured in the interlock openings 26 and 28 of the end blank 4″ as indicated at 56, 58 in FIGS. 6 and 12. Preferably, the placing of the housing 6 over the end blank 4″ and securing the housing to the end blank occurs before severing the end blank from the strip at the blank edge 4‴. In FIG. 12 the end blank 4″ and its housing 6 are severed from the strip 4′ at the blank edge 4‴ of the end of the blank 4″ to form the substantially completed plug-in fuse assembly, but with the transverse web 10′ still intact. Thereafter, the transverse web 10′ is blanked at 12 to provide the spaced apart terminal forming blade portions 8 as indicated in FIG. 12. Thereafter, the ends of the terminal forming blade portions 8 may be coined as illustrated at 9 to form tapered ends for the terminal forming blade portions. In this way, the complete plug-in fuse assembly as illustrated in FIGS. 12 and 1 may be provided.

As expressed above, the strip 4′ of fuse metal may be plated, such as tin plated, to provide good electrical contact between the terminal forming blade portions 8—8 and the pressure clip terminals in a mounting panel in which they are received.

While for purposes of illustration herein one preferred specific method of making the plug-in fuse assembly has been disclosed herein, other methods may become apparent to those skilled in the art upon reference to this disclosure and, therefore, this invention is to be limited only by the scope of the appended claims.

I claim:

1. The method of making a plug-in fuse element including a plate-like body of fuse metal having a pair of terminal forming blade portions to be received by pressure clip terminals in a mounting panel, current carrying extensions at the inner end portions of the pair of terminal forming blade portions and a fuse-forming link portion interconnecting the current carrying extensions, said method comprising the steps of providing a blank of fuse metal which is initially longitudinally provided throughout its length with a continuous portion of reduced thickness, blanking said blank of fuse metal to leave a pair of juxtaposed, spaced, terminal forming blade portions and current carrying extensions thereof on opposite sides of said portion of reduced thickness, said blanking operation forming in said portion of reduced thickness a fuse-forming link interconnecting said current carrying extension.

2. The method defined in claim 1 wherein the thickness of the reduced portion of the blank of fuse metal and, hence, the thickness of the fuse-forming link of the plug-in element, is selectively varied and controlled to provide plug-in fuse assemblies with desired fuse ratings.

3. The method as defined in claim 1 wherein the continuous portion of reduced thickness throughout the length of the blank of fuse metal is reduced by a step including milling.

4. The method as defined in claim 1 wherein the continuous portion of reduced thickness througout the length of the blank of fuse metal is reduced by a step including decreasing the thickness from both sides of the blank.

5. The method as defined in claim 1 wherein the continuous portion of reduced thickness throughout the length of the blank of fuse metal is reduced by a step including decreasing the thickness from one side only of the blank.

6. The method as defined in claim 5 wherein the step including decreasing the thickness from one side only of the blank comprises milling said one side only of the blank with the other side of the blank being flat.

7. The method of claim 1 wherein there is connected between said current carrying extensions a body of insulating material forming a hand grippable surface and a rigid interconnection between said current carrying extensions.

8. The method of claim 7 wherein said insulating body extends in spaced relation about said fuse-forming link to form a housing therefor.

9. The method of making a plug-in fuse assembly comprising a plug-in element including a plate-like body of fuse metal having a pair of terminal forming blade portions to be received by pressure clip terminals or the like, current carrying extensions at the inner end portions of the pair of terminal forming blade portions and a fuse-forming link interconnecting the current carrying extensions, and insulating means secured to the plate-like body with the pair of terminal forming blade portions thereof extending outwardly therefrom, said method comprising the steps of providing a blank of fuse metal which is initially longitudinally provided throughout its length with a continuous portion of reduced thickness, blanking said portion of reduced thickness of said blank of fuse metal to leave a pair of spaced confronting generally parallel terminal forming blade portions and current carrying longitudinal extensions thereof on opposite sides of what was said portion of reduced thickness, said blanking forming in said portion of reduced thickness a relatively fragile fuse-forming link interconnecting said current carrying extensions and a web interconnecting said terminal forming blade portions, said web being of sufficient width to form a rigid interconnection between said terminal forming blade portions, securing between said current carrying extensions insulating means forming a rigid interconnection therebetween with the pair of terminal blade portions of the blank, which are interconnected by the web of reduced thickness, extending outwardly from the insulating means, and blanking the exposed web of fuse metal of reduced thickness interconnecting the terminal blade portions to complete the formation of the plug-in fuse assembly.

10. The method of making a plug-in fuse assembly comprising a plug-in element including a plate-like body of fuse metal having a pair of terminal forming blade portions to be received by pressure clip terminals in a mounting panel, current carrying extensions at the inner end portions of the pair of terminal forming blade portions and a fuse-forming link interconnecting the current carrying extensions, said method comprising the steps of providing a continuous strip of fuse metal initially longitudinally provided throughout its length with a continuous portion of reduced thickness, sequentially advancing the continuous strip of fuse metal, blanking said continuous strip of fuse metal to provide at spaced intervals in said strip longitudinally interconnected blanks each containing a pair of spaced terminal forming blade portions and current carrying extensions thereof on opposide sides of said portion of reduced thickness of the strip of fuse metal, said blanking operation forming for each interconnected blank within said portion of reduced thickness a fuse-forming link interconnecting said current carrying extensions thereof, and severing the end blank from the sequentially advanced strip of fuse metal.

11. The method of claim 10 wherein said blanking operation also forms for each longitudinally interconnected blank within said portion of reduced thickness thereof a web extending between said terminal forming blade portions, which web is of sufficient width to form a rigid interconnection between said terminal forming blade portion, securing between said current carrying extensions of each end blank insulating means forming a rigid interconnection therebetween, with said terminal forming blade portions and web located externally of said insulating means, and blanking the exposed web of each end blank after application of said insulating means.

12. The method of claim 11 wherein said insulating means extends in spaced confining relation about the associated fuse-forming link to form a housing therefor.

13. The method as defined in claim 10 wherein the thickness of the reduced portion of the continuous strip of fuse metal and, hence, the thickness of the fuse-forming link of the plug-in element is selectively varied and controlled to provide plug-in fuse assemblies with desired fuse ratings.

14. The method as defined in claim 10 wherein the continuous portion of reduced thickness throughout the length of the strip of fuse metal is reduced by a step including milling.

15. The method as defined in claim 11 wherein the continuous portion of reduced thickness throughout the length of the strip of fuse metal is reduced by a step including decreasing the thickness from both sides of the strip.

16. The method as defined in claim 10 wherein the continuous portion of reduced thickness throughout the length of the strip of fuse metal is reduced by a step including decreasing the thickness from one side only of the strip.

17. The method as defined in claim 16 wherein the step including decreasing the thickness from one side only of the strip comprises milling said one side only of the strip with the other side of the strip being flat.

18. A method of making a plug-in fuse element comprising a plug-in element including a pair of spaced confronting generally parallel terminal forming blade portions to be received by pressure clip terminals or the ike, a pair of confronting current carrying extensions projecting longitudinally from the inner ends of the pair of terminal forming blade portions and a fuse-forming link portion interconnecting the current carrying extensions, said method comprising the steps of providing a sheet-like blank of fuse metal initially provided within the longitudinal margins thereof with a longitudinally extending portion of reduced thickness extending the full length of the blank, blanking said portion of reduced thickness to leave on opposite sides thereof a pair of spaced confronting general parallel terminal forming blade portions to be received by pressure clip terminals of the like and confronting current carrying extensions projecting longitudinally from the inner end portions of said terminal forming blade portions, and a fuse-forming link formed in said portion of reduced thickness extending between the confronting portions of said current carrying extensions.

* * * * *